US010118679B2

(12) United States Patent
Stave

(10) Patent No.: US 10,118,679 B2
(45) Date of Patent: Nov. 6, 2018

(54) JETTISON DEVICE FOR A SHIP, PLATFORM OR OTHER VESSELS

(71) Applicant: St-Technologies AS, Ulsteinvik (NO)

(72) Inventor: Perry Normann Stave, Brandal (NO)

(73) Assignee: ST-Technologies AS, Ulsteinvik (NO)

( * ) Notice: Subject to any disclaimer, the term of this patent is extended or adjusted under 35 U.S.C. 154(b) by 0 days.

(21) Appl. No.: 15/294,507

(22) Filed: Oct. 14, 2016

(65) Prior Publication Data

US 2017/0106952 A1 Apr. 20, 2017

(30) Foreign Application Priority Data

Oct. 15, 2015 (NO) ..... 20151400

(51) Int. Cl.
*B63B 22/24* (2006.01)
*B63B 43/00* (2006.01)
*B63B 19/08* (2006.01)

(52) U.S. Cl.
CPC ..... *B63B 43/00* (2013.01); *B63B 19/08* (2013.01); *B63B 2201/18* (2013.01)

(58) Field of Classification Search
CPC ..... B63B 43/00; B63B 19/08
See application file for complete search history.

(56) References Cited

U.S. PATENT DOCUMENTS 4,266,500 A * 5/1981 Jurca ..... B63B 22/20 102/414
5,025,423 A * 6/1991 Earp ..... G01S 7/539 367/135
6,164,236 A * 12/2000 Liu ..... B63C 9/22 114/343
6,672,242 B2 * 1/2004 Webb ..... B63B 23/10 114/365
2004/0149194 A1 8/2004 Schmidt
2012/0074138 A1 * 3/2012 Schutz ..... B65D 77/0466 220/88.1
2016/0023722 A1 * 1/2016 Hesse ..... B63G 8/42 114/259

FOREIGN PATENT DOCUMENTS

CA 2 151 880 A1 12/1996
DE 283 155 A5 10/1990
DE 10 2012 005136 A1 6/2014
(Continued)

OTHER PUBLICATIONS

Extended European Search Report received in European Patent Application No. 16193836.0, dated Feb. 22, 2017.

*Primary Examiner* — Stephen P Avila
(74) *Attorney, Agent, or Firm* — Knobbe, Martens, Olson & Bear, LLP

(57) ABSTRACT

A jettison device isolates an object, particularly a potentially hazardous object on a ship, platform or similar object. The jettison device includes a housing with an opening configured to face towards an outside region, and a container configured to hold one or more of the objects. The jettison device further includes a container lock and a container jettison. A ship, platform or other vessel includes at least one of the jettison devices above and at least one jettison device arranged in or near a hull surface with the opening facing a region outside the hull surface.

15 Claims, 3 Drawing Sheets

(56) References Cited

FOREIGN PATENT DOCUMENTS

| | | | |
|---|---|---|---|
| EP | 1 886 915 | A1 | 2/2008 |
| NO | 20 054 390 | A | 3/2007 |
| NO | 327 449 | B1 | 7/2009 |
| RU | 2 046 730 | C1 | 10/1995 |
| WO | WO 2006/107839 | A2 | 10/2006 |

* cited by examiner

JETTISON DEVICE FOR A SHIP, PLATFORM OR OTHER VESSELS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD OF THE INVENTION

The invention concerns a jettison device for a ship, platform or similar, particularly for a potentially hazardous object.

BACKGROUND OF THE INVENTION

Most ships and other ocean-going vessels, as well as mobile and stationary platforms for offshore use, have a number of potentially hazardous objects on board. Such objects may be pressurized gas cylinders (also referred to as gas bottles), canisters containing explosives, or other flammable or explosive substances or objects. A common denominator for these objects is that they pose a threat to the ship or platform, including its crew, in case of fire. Maritime regulations stipulate that in case of a fire in the vicinity of gas bottles, the bottles shall be moved to a safe area. The process of locating and removing such gas bottles is time-consuming, and potentially hazardous, and tends to delay the fire-fighting operations. It is therefore a need for a device by means of which such hazardous objects may be isolated.

CA 2 151 880 A1 describes a flexible, inflatable, recoverable "environmental hazard container assembly", capable of containing a product while not allowing the introduction of any contaminants, and able to be rapidly deployed from either a vessel or a barge. The assembly is comprises a container, a cap, a storage and deployment device. In operation, latches holding a lid and platform portions of a box are tripped manually. Hydraulic cylinders located on the sides of the box are then activated, which rotates the main part of the box upward and outward around the hinge connecting the main part of the box to the platform.

DD 283 115 A5 describes a device configured for—in one operation—throwing a container from a ship, particularly a container with dangerous content. A container frame is provided with two rocker arms, which are hinged to the frame, parially supporting the container, and driven by actuators. When the pivot arms are lifted, the container is released from its attachment to the frame and is allowed to fall into the water.

SUMMARY OF THE INVENTION

The invention is set forth and characterized in the main claim, while the dependent claims describe other characteristics of the invention.

It is thus provided a jettison device for a ship, platform or similar, comprising a housing having an opening configured for facing towards an outside region of the ship or platform, a container for holding one or more objects, and removably arranged in the housing and locked in the housing via releasable locking means (28); a launch platform releasably connected to the housing and configured for supporting the container; characterized by complementary slanted surfaces on the launch platform and the container, respectively, or by a releasable hinged connection between the container and the launch platform. The container may comprise a cover panel configured for covering the opening.

In one embodiment, the container comprises signal emitting means, such as sonar transmitters or similar. The container may comprise retrieval means, whereby the container may retrieved from a submerged state. The container jettison means may comprise complementary slanted surfaces on the launch platform and the container, respectively.

It is also provided a ship, platform or other vessel, characterized in that it comprises at least one of the jettison devices and that at least one jettison device is arranged in or near a hull surface, with the opening facing a region outside the hull surface.

The invented system provides a jettison device for removing potentially hazardous objects (such as gas bottles) from a secure storage position on in or near the side of a ship, platform or other vessel, and deploying the object(s) safely to sea.

BRIEF DESCRIPTION OF THE DRAWINGS

These and other characteristics of the invention will become clear from the following description of a preferential form of embodiment, given as a non-restrictive example, with reference to the attached schematic drawings, wherein.

DETAILED DESCRIPTION OF THE INVENTION

Figure 1:
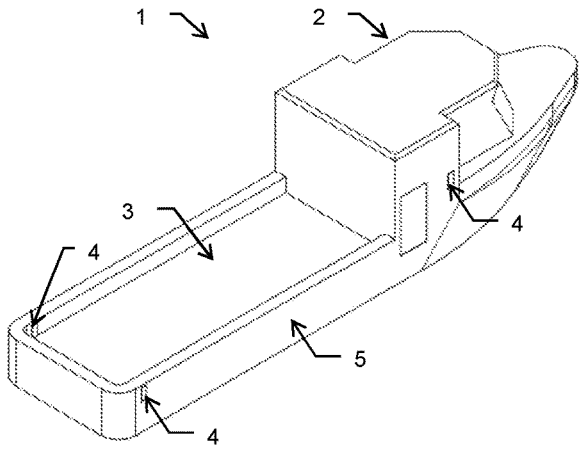
FIG. 1 is a perspective view of a ship having a plurality of the invented jettison device.

The following description will use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

FIG. 1 illustrates the invented jettison device 4 installed on a ship 1 having a superstructure 2 and a cargo deck 3. All jettison devices are installed in an opening in the hull surface 5. Although three jettison devices 4 are shown in FIG. 1, it should be understood that fewer or more devices may be installed. They may be installed at suitable locations on the vessel. Also, the invention shall not be limited to installation on a ship, but is equally applicable to installation on any floating vessel, as well as to floating and fixed platforms.

Figure 2:
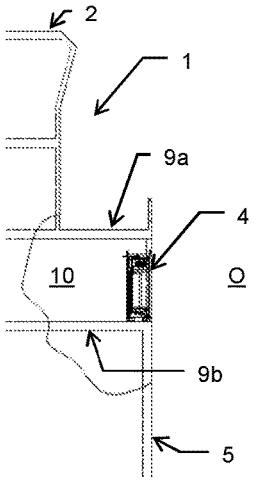
FIG. 2 is a part-sectional drawing of a ship's hull, illustrating the invented jettison device arranged in the vicinity of the hull surface.

FIG. 2 shows the jettison device 4 installed in an inboard compartment 10 between an upper deck 9*a* and a lower deck 9*b*, facing the outside O of the ship through an opening in the hull surface 5.

Figure 3:
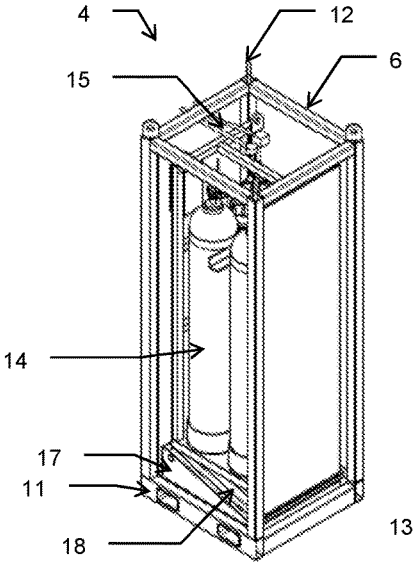
FIG. 3 is a perspective view of an embodiment of the invented jettison device.
Figure 4:
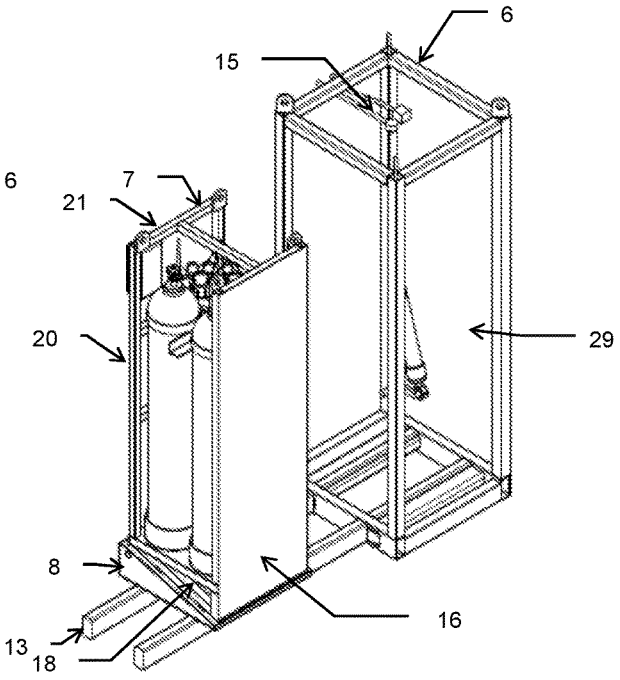
FIG. 4 is a perspective view of the embodiment shown in FIG. 3, but where the removable container and launch platform are outside its housing.

Referring now to FIGS. 3 and 4, the jettison device 4 comprises a housing 6, a launch platform 8 and a removable container 7. In the illustrated embodiment, the housing 6 comprises a steel frame with lifting pad eyes 12. The housing 6 also comprises forklift openings 11 in a lower base 19. The lower base 19 provides a support for the launch platform 8. The launch platform 8 comprises in the illustrated embodiment an upward-slanting base 17 and a rear wall 20. The launch platform 8 may be removable (as shown in the figures) from the housing 6 and connected to the housing by means (not shown) that per se are known, but may alternatively be permanently integrated in the housing.

The removable container 7 comprises a protective cage structure 21 on a downward-slanting base 18, the base being configured for support on the upward-slanting base 17 as shown in FIGS. 3 and 4, and a cover panel 16. The slanting bases are preferably equipped with a material with low friction. In the position shown in FIGS. 3 and 4, the bases 17, 18 are locked with respect to one another by suitable releasable locking means (not shown), such as rotatable latches, electro-magnetic couplers, etc. The downward-slanting base 18 on the removable container also provides a support for the desired cargo. In the illustrated embodiment, this cargo is four gas bottles 14. The gas bottles are connected to onboard systems and/or appliances via hoses with quick-release couplings 15, as is known in the art. The cover panel 16 is preferably designed to be generally flush with the hull surface 5 when the jettison device is installed in a ship (see e.g. FIG. 2).

Figure 5:
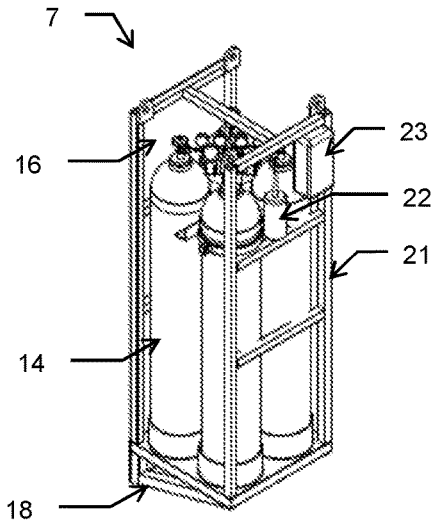
FIG. 5 is a perspective view of the removable container, as shown in FIG. 3, but from a different perspective.

Referring to FIG. 5, showing the removable container 7 from another perspective than that shown in FIGS. 3 and 4, the removable container also comprises a sonar transmitter 22 and cartridge 23 for retrieval devices (to be described below).

The complete jettison device 4 (as shown in FIG. 3) may be installed in a ship, platform or other vessel as one unit. The jettison device may installed in new-builds or retrofitted into existing vessels. Such installation or retrofitting will typically entail that the housing 6 is bolted or welded to a deck 9*b*, near the hull surface 5 and having an opening 29 facing the outside O, shown in FIG. 2.

FIG. 4 illustrates a situation where the removable container 7 and launch platform 8 are moved into (or out of) the housing 6, via removable skidding beams 13. Such removal or insertion is relevant if the removable container is to be replaced, removed for repair or refurbishment, or for use elsewhere on the ship. It should thus be understood that the removable container 7 may be a mobile unit.

Figure 6:
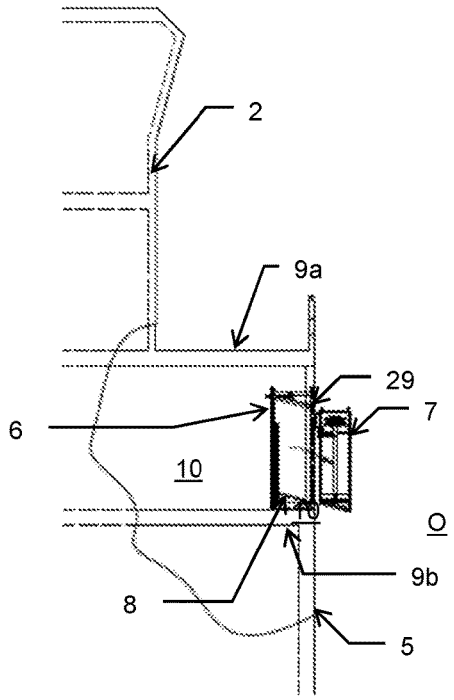
FIG. 6 is a part-sectional drawing, illustrating the removable container being jettisoned from the housing.

FIGS. 2 and 3 illustrate the jettison device 4 in a stand-by position, i.e. with the removable container 7 (with its gas bottles 14) and the launch platform 8 installed and locked in the housing 6. In this position, the gas bottles are supplying the relevant on-board systems via the couplings 15. In an emergency, for example an on-board fire, where it becomes necessary to isolate or remove the hazardous cargo (e.g. gas bottles) 14, the removable container 7 is released from the launch platform 8 by unlocking the aforementioned locking devices (not shown). Such unlocking may be done manually at the jettison device, remotely, or automatically (e.g. as a response to a temperature sensor input). When the unlocking procedure has been completed, the removable container 7 is no longer locked to the housing 6 (and its launch platform 8) and will slide out of the housing 6 opening 29 by virtue of the complementary slanting bases 17, 18 and under the influence of gravitational forces. As the slanting bases are oriented with a sliding direction facing the hull surface 5, the removable container 7 will slide out of the housing opening 29 and consequently out of the hull surface 5, as illustrated in FIG. 6. The removable container is thus falling away from the ship, and into the sea. The potentially hazardous gas bottles are thus removed from the fire.

Although not shown, it should be understood that the launch platform or/and housing may comprise ejection means, for example explosive charges, pressurized cartridges, loaded spring devices, or other actuators, configured to push the container 7 out of the housing 6.

The removable container 7 may be furnished with floatation devices (not shown), whereby it will remain floating in the water surface. However, in a hazardous situation, for example involving a fire, it may be advantageous to have the removable container sink to the seabed or to a predetermined depth beneath the water surface. Therefore the removable container may be furnished with suitable weights and/or buoyancy devices (not shown) as the case may be.

Figure 7:
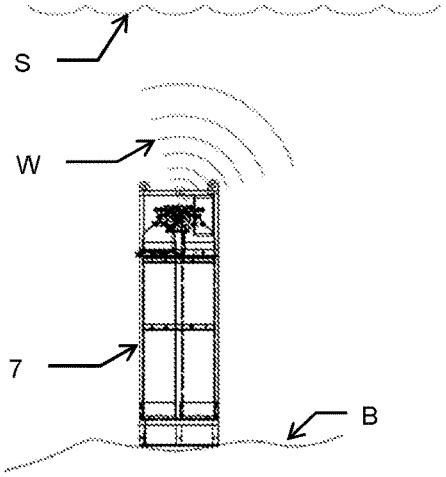
FIGS. 7 and 8 are side views of embodiments of the removable device, located on a seabed.
Figure 8:
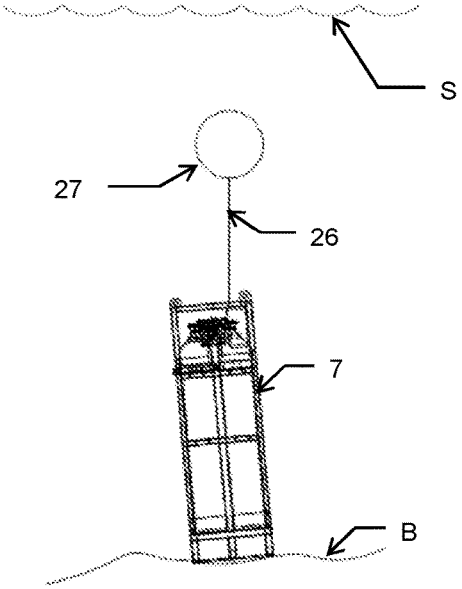

FIGS. 7 and 8 illustrate two retrieval devices for submerged containers 7, resting on a seabed B below a water surface S. The container 7 may comprise a sonar transmitter 22 (FIG. 5) configured to emit acoustic waves W when the container 7 is submerged. Also, alternatively or as a supplement, the container 7 may comprise a retrieval tether 26 and buoyancy device 27.

Figure 9:
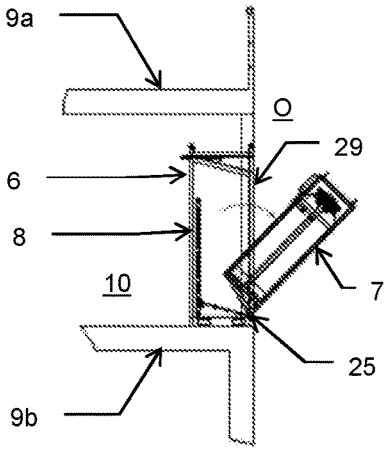
FIGS. 9 and 10 as part-sectional views illustrating alternative jettisoning means.

FIG. 9 illustrates an alternative container launching means. Instead of the container 7 sliding out of the housing 6 as described above, a releasable hinged connection 25 is provided between the container and the launch platform. When the locking means (not shown) are released, the container 7 pivots out of the housing, either by a ship rolling or pitching movement or aided by an ejection mechanism (not shown).

Figure 10:
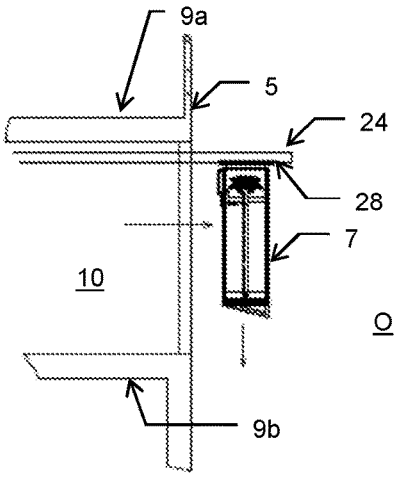

FIG. 10 illustrates yet another alternative container launching means. Here, the container 7 is suspended by an beam 24, which is extendable from an inboard compartment 10 to beyond the hull surface 5. When the extendable beam 24 (alternatively a telescopic beam) has been moved to the position shown in FIG. 10, a locking mechanism 28 is released, whereupon the container is allowed to free-fall from the beam.

A key feature of the invented jettison device 7 is that it is installed in or near the hull surface 5, such that at least one side of the jettison device is facing environment outside the ship O. In addition to the advantages mentioned above, this close proximity to the outside environment also provides for efficient cooling of the gas bottles, due to their exposure to the ambient air.

Figure 11:
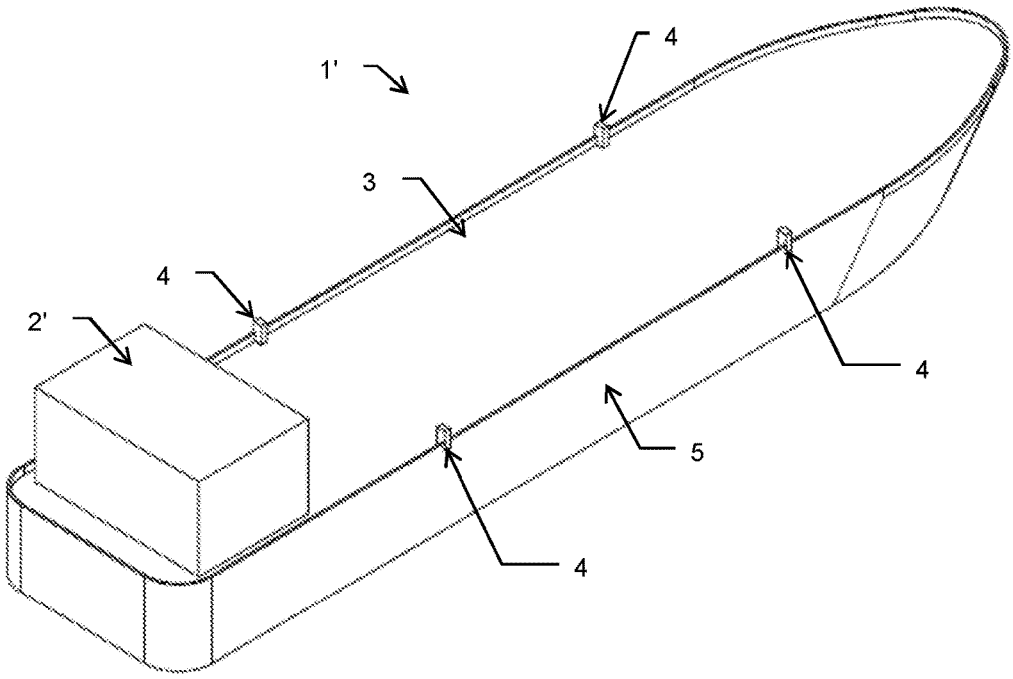
FIG. 11 is a perspective view of a ship having a plurality of the invented jettison device.

An alternative placement of the jettison device 4, on a ship 1' having an aft superstructure 2', is illustrated in FIG. 11.

What is claimed is:

1. A jettison device for a ship or platform, comprising:

a housing having an opening configured to face towards an outside region of the ship or platform, a container configured to hold one or more objects removably arranged in the housing and locked in the housing via a releasable lock, the container comprising a base at the bottom of the container, wherein a bottom surface of the base of the container is configured to slant downward toward the opening;

a launch platform releasably connected to the housing and configured to support the container, the launch platform comprising a base having an upper surface that is configured to slant upward away from the opening; and a weight and buoyancy device connected to the container, configured to cause the container to sink to a predetermined depth in water;

wherein the upward-slanting surface of the base of the launch platform complementarily contacts the downward-slanting surface of the base of the container, and wherein a releasable hinged connection is formed between the container and the launch platform.

2. The jettison device of claim 1, wherein the container comprises a cover panel configured to cover the opening.

3. The jettison device of claim 1, wherein the container comprises a signal emitter comprising a sonar transmitter.

4. The jettison device of claim 1, wherein the container comprises a retriever.

5. The jettison device of claim 1, further comprising a support-and-jettison comprising a beam which is extendable from an inboard compartment of the ship, or platform to beyond a hull surface.

6. A ship, platform or other vessel comprising the jettison device of claim 1, wherein the jettison device is arranged in or near a hull surface with the opening facing an outside region of the hull surface.

7. The jettison device of claim 1, wherein the container is configured to sink to a seabed or to a predetermined depth beneath a water surface.

8. A jettison device for a ship or platform, comprising:

a housing having an opening configured to face towards an outside region of the ship or platform, a container configured to hold one or more objects; the container being removably arranged in the housing and locked in the housing via a releasable lock; the container comprising a protective cage structure holding said one or more objects and a base at the bottom of the protective cage structure, wherein a bottom surface of the base of the container is configured to slant downward toward the opening with respect to a bottom surface of the protective cage structure of the container;

a launch platform releasably connected to the housing and configured to support the container, the launch platform comprising a base having an upper surface; and a weight and buoyancy device connected to the container, configured to cause the container to sink to a predetermined depth in water;

wherein the upper surface of the base of the launch platform complementarily contacts the base of the container, and wherein a releasable hinged connection is formed between the container and the launch platform.

9. The jettison device of claim 8, wherein the container comprises a cover panel configured to cover the opening.

10. The jettison device of claim 8, wherein the container comprises a signal emitter comprising a sonar transmitter.

11. The jettison device of claim 8, wherein the container comprises a retriever.

12. The jettison device of claim 8, further comprising a support-and-jettison comprising a beam which is extendable from an inboard compartment of the ship, or platform to beyond a hull surface.

13. The jettison device of claim 8, wherein the container is configured to sink to a seabed or to a predetermined depth beneath a water surface.

14. A ship, platform or other vessel, comprising the jettison device of claim 8, wherein the jettison device is arranged in or near a hull surface, with the opening facing the outside region of the hull surface.

15. The jettison device of claim 1, further comprising a temperature sensor measuring a temperature on the ship or platform, wherein the releasable lock is unlocked in response to the temperature measured by the temperature sensor.

* * * * *